US009626895B2

(12) United States Patent
Tsai et al.

(10) Patent No.: US 9,626,895 B2
(45) Date of Patent: Apr. 18, 2017

(54) GATE DRIVING CIRCUIT

(71) Applicant: Chunghwa Picture Tubes, LTD., Taoyuan (TW)

(72) Inventors: Chi-Chung Tsai, Kinmen County (TW); Yi-Kai Chen, Tainan (TW); En-Chih Liu, Taoyuan (TW); Yen-Yu Huang, Taoyuan (TW)

(73) Assignee: Chunghwa Picture Tubes, Ltd., Taoyuan (TW)

( * ) Notice: Subject to any disclaimer, the term of this patent is extended or adjusted under 35 U.S.C. 154(b) by 0 days.

(21) Appl. No.: 14/834,800

(22) Filed: Aug. 25, 2015

(65) Prior Publication Data

US 2017/0061855 A1 Mar. 2, 2017

(51) Int. Cl.
*G09G 5/00* (2006.01)
*G09G 3/20* (2006.01)

(52) U.S. Cl.
CPC ... *G09G 3/2092* (2013.01); *G09G 2300/0804* (2013.01); *G09G 2300/0871* (2013.01); *G09G 2310/0232* (2013.01); *G09G 2310/0248* (2013.01); *G09G 2310/04* (2013.01); *G09G 2310/08* (2013.01)

(58) Field of Classification Search
CPC .. G09G 3/2092; G09G 3/3266; G09G 3/3674; G09G 3/3677; G09G 2310/0286; H03K 3/356026; H03K 3/356052; H03K 3/356034; G11C 19/00
See application file for complete search history.

(56) References Cited

U.S. PATENT DOCUMENTS 9,024,676 B2 * 5/2015 Ofuji ..... H03K 17/005 327/365
9,041,453 B2 * 5/2015 Miyake ..... G09G 3/3677 327/242
9,064,474 B2 * 6/2015 Chou ..... G09G 3/3677
2014/0055333 A1 * 2/2014 Lin ..... G09G 3/3611 345/100

FOREIGN PATENT DOCUMENTS

TW I269253 12/2006

* cited by examiner

*Primary Examiner* — Jennifer Mehmood
*Assistant Examiner* — Sardis F Azongha
(74) *Attorney, Agent, or Firm* — J.C. Patents

(57) ABSTRACT

A gate driving circuit is provided. The gate driving circuit includes a plurality of gate driving units sequentially coupled to each other. Each of the gate driving units includes a shift register and a de-multiplexer. The shift register receives a start pulse signal, and generates a first control signal and a second control signal according to the start pulse signal and a scan controlling signal, where when the shift register converts the first control signal into the second control signal, the shift register pulls down a voltage level of the first control signal according to the second control signal. The de-multiplexer receives a part of a plurality of clock signals for generating a plurality of gate signals sequentially according to the first control signal, where the clock signals are enabled sequentially, and enable periods of two sequential clock signals are partially overlapped with each other.

13 Claims, 7 Drawing Sheets

GATE DRIVING CIRCUIT

BACKGROUND OF THE INVENTION

1. Field of the Invention

The present invention generally relates to a gate driving circuit, in particular, to a gate driving circuit capable of executing a pre-charging operation.

2. Description of Related Art

Along with developments in optoelectronics and semiconductor technology, flat panel displays have been widely used recently. For reducing costs and achieving narrow border design requirements, a gate in panel (GIP) technology has been developed. However, since a trend nowadays is to make the display panel conform to high resolution, RC loading of the conductive circuits disposed in the periphery circuit area may be increased, which may cause the gate driving circuit being incapable of providing a sufficient high driving voltage for driving the display panel.

Therefore, how to take into account the driving capability and the narrow border design requirements for being adapted to high resolution may be a goal to pursue for those skilled in the art.

SUMMARY OF THE INVENTION

Accordingly, the present invention is directed to a gate driving circuit, which is capable of executing a pre-charging operation, such that all the design requirements of good driving capability, high resolution and the narrow border may be achieved.

The invention provides a gate driving circuit. The gate driving circuit includes a plurality of gate driving units sequentially coupled to each other. Each of the gate driving units includes a shift register and a de-multiplexer. The shift register receives a start pulse signal, and generates a first control signal and a second control signal according to the start pulse signal and a scan controlling signal, where when the shift register converts the first control signal into the second control signal, the shift register pulls down a voltage level of the first control signal according to the second control signal. The de-multiplexer is coupled to the shift register. The de-multiplexer receives a part of a plurality of clock signals for generating a plurality of gate signals sequentially according to the first control signal, where the clock signals are enabled sequentially, and enable periods of two sequential clock signals are partially overlapped with each other.

In an embodiment of the invention, the gate driving circuit receives k clock signals, and each of the de-multiplexers receives n clock signals in the k clock signals sequentially for generating n gate signals sequentially, wherein k, n are positive integers and k is larger than n.

In an embodiment of the invention, the de-multiplexer provides the (n−1)th gate signal in the n gate signals as a start pulse signal of a next-stage gate driving unit.

In an embodiment of the invention, the shift register includes a pull-down switch. The pull-down switch receives the first control signal and the second control signal, and is turned on or off according to the second control signal for pulling down the voltage level of the first control signal to a low-voltage signal.

In an embodiment of the invention, the pull-down switch includes a first transistor having a first end, a second end and a control end. The first end of the first transistor receives the first control signal, the second end of the first transistor receives the low-voltage signal, and the control end of the first transistor receives the second control signal.

In an embodiment of the invention, the shift register further includes a second transistor, a third transistor, a fourth transistor and a fifth transistor. The second transistor has a first end, a second end and a control end, where the first end of the second transistor receives a forward scanning signal, and the control end of the second transistor receives the start pulse signal. The third transistor has a first end, a second end and a control end, where the first end of the third transistor receives a backward scanning signal, the control end of the third transistor receives a reset signal, and the second end of the third transistor and the second end of the second transistor are coupled to each other and generate the first control signal. The fourth transistor has a first end, a second end and a control end, where the first end of the fourth transistor receives the backward scanning signal, and the control end of the fourth transistor receives the start pulse signal. The fifth transistor has a first end, a second end and a control end, where the first end of the fifth transistor receives the forward scanning signal, the control end of the fifth transistor receives the reset signal, and the second end of the fifth transistor and the second end of the fourth transistor are coupled to each other and generate the second control signal. The shift register determines a voltage level of the forward scanning signal according to the scan controlling signal, and determines a voltage level of the backward scanning signal according to the scan controlling signal, wherein the voltage levels of the forward scanning signal and the backward scanning signal are different.

In an embodiment of the invention, the reset signal is determined according to the second gate signal generated by the next-stage gate driving circuit.

In an embodiment of the invention, the shift register further includes a sixth transistor and a first capacitor. The sixth transistor has a first end, a second end and a control end. The first end of the sixth transistor receives a high-voltage signal, the second end of the sixth transistor is commonly coupled to the second ends of the fifth transistor and the fourth transistor, and the control end of the sixth transistor receives a refresh signal, where the refresh signal is one of the k clock signals except from the n clock signals. One end of the first capacitor receives the low-voltage signal, and another end of the first capacitor is coupled to the second end of the sixth transistor.

In an embodiment of the invention, the refresh signal is determined according to a second clock signal received by the next-stage gate driving unit.

In an embodiment of the invention, the shift register further includes an isolated switch coupled to the control end of the sixth transistor. The isolated transistor receives the second control signal, and turns on or off according to the second control signal, where the sixth transistor receives the refresh signal through the isolated switch.

In an embodiment of the invention, the de-multiplexer includes a plurality of signal transmitting units. The signal transmitting units receives the n clock signals, the first control signal and the second control signal, where the signal transmitting units are turned on simultaneously according to the first control signal, and the signal transmitting units receives the n clock signals respectively for generating the n gate signals respectively, where the signal transmitting units are turned off simultaneously according to the second control signal.

In an embodiment of the invention, the signal transmitting units are turned on or off according to a turn-on control signal, where the turn-on control signal is the (n−1)th clock signal received by a previous-stage gate driving circuit.

In an embodiment of the invention, each of the signal transmitting units includes a seventh transistor, an eighth transistor, a second capacitor and a ninth transistor. The seventh transistor has a first end, a second end and a control end, where the first end of the seventh transistor receives the first control signal, and the control end of the seventh transistor receives a high-voltage signal. The eighth transistor has a first end, a second end and a control end, where the first end of the eighth transistor receives one of the n clock signals, the second end of the eighth transistor provides a gate signal corresponding to each of the signal transmitting units, and the control end of the eighth transistor is coupled to the second end of the seventh transistor. The second capacitor is coupled between the control end of the eighth transistor and the second end of the eighth transistor. The ninth transistor has a first end, a second end and a control end, where the first end of the ninth transistor is coupled to the second end of the eighth transistor, the second end of the ninth transistor receives a low-voltage signal, and the control end of the ninth transistor receives the second control signal.

In an embodiment of the invention, the control end of the seventh transistor further comprises receiving a turn-on control signal, where the turn-on control signal is the (n−1)th clock signal received by a previous-stage gate driving circuit.

In an embodiment of the invention, the start pulse signal, a refresh signal and the turn-on control signal corresponding to a same gate driving unit are a same clock signal of the k clock signals.

In an embodiment of the invention, the second control signal is an inverting signal of the first control signal.

In an embodiment of the invention, a number of the clock signals used by the gate driving circuit and a number of the clock signals received by each of the de-multiplexers are mutually prime.

Based on the above, the gate driving circuit disclosed by the embodiments of the invention may allow enable periods of two sequential clock signals to be overlapped with each other, so as to pre-charge gate signals effectively. In this way, the driving capability may be enhanced, and the design requirements of high resolution and narrow border may be achieved.

In order to make the aforementioned and other features and advantages of the invention more comprehensible, embodiments accompanying figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1A:
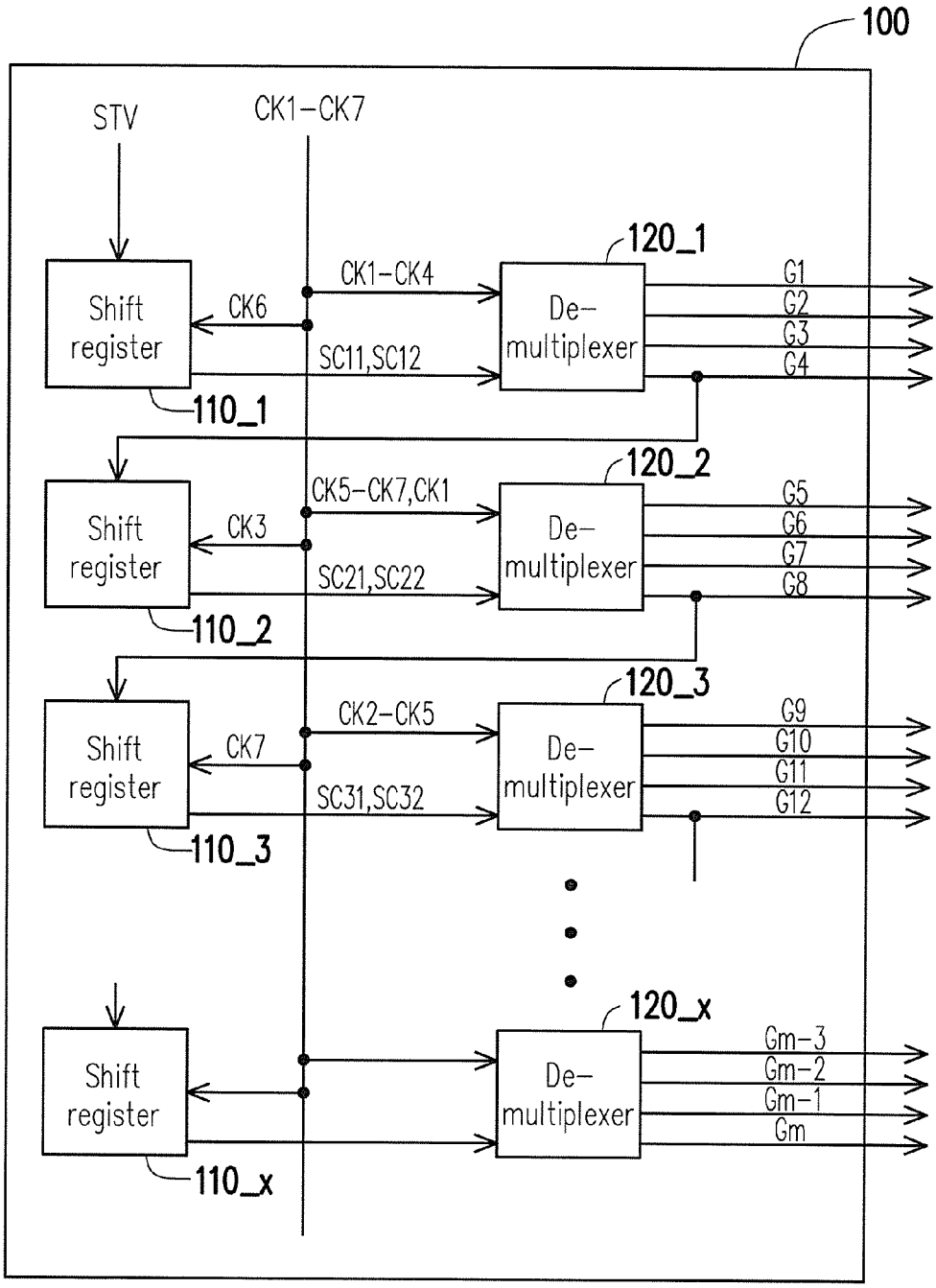
FIG. 1A is a schematic diagram illustrating a gate driving circuit.

Reference will now be made in detail to the present preferred embodiments of the invention, examples of which are illustrated in the accompanying drawings. Wherever possible, the same reference numbers are used in the drawings and the description to refer to the same or like parts.

The embodiments of the present invention provides a gate driving circuit having a de-multiplexing function by using the GIP technology, which may allow enable periods of two sequential clock signals to be overlapped with each other, so as to pre-charge gate signals effectively. Thereby, all the design requirements of good driving capability, high resolution and the narrow border may be achieved.

A brief introduction to a gate driving circuit having a de-multiplexing function will be described in embodiments of FIG. 1A to FIG. 1C. Referring to FIG. 1A first, FIG. 1A is a schematic diagram illustrating a gate driving circuit, which may be used for driving, for example, a display panel with independent signals but being incapable of executing a pre-charging operation.

Specifically, a gate driving circuit 100 includes a plurality of shift registers 110_1~110_*x* and a plurality of de-multiplexers 120_1~120_*x*, and the gate driving circuit 100 may provide a plurality of gate signals G1~Gm for driving. The x and in are integers, and m is a multiple of x. Besides, each shift register and de-multiplexer coupled to each other may be regarded as a gate driving unit of one stage. For instance, the register 110_1 and the de-multiplexer 120_1 may constitute a first-stage gate driving unit, the register 110_2 and the de-multiplexer 120_2 may constitute a second-stage gate driving unit, and so on. The shift registers 110_1~110_*x* respectively receive an start pulse signal STV or the last gate signal provided by the gate driving unit of the previous stage, and one of the clock signals, to respectively provide first control signals (e.g. SC11, SC21 and SC31) and second control signals (e.g. SC12, SC22 and SC32). Herein, a first control signal and a second control signal provided by a same shift register (e.g. the first control signal SC11 and the second control signal SC12 provided by the same shift register 110_1) are generated respectively by two independent sub-circuits, which may be described in detail later. In addition, the first control signals may be used for respectively turning on the de-multiplexers 120_1~120_*x*, and the second control signals may be used for respectively turning off the de-multiplexers 120_1~120_*x*.

The de-multiplexers 120_1~120_*x* respectively receive the first control signals and the second control signals. Besides, the de-multiplexers 120_1~120_*x* also respectively receive a part of the clock signals CK1~CK7 for generating corresponding gate signals. In the present embodiment, each of the de-multiplexers 123$_{1}$~123_*x* receives four clock signals of the clock signals CK1~CK7. The clock signals CK1~CK7 may be individually transmitted through the line or transmitted through a bus.

A detailed circuit configuration of a gate driving unit will be described as follows. Referring to FIG. 1B, FIG. 1B is a circuit diagram illustrating a shift register 110_1 and a de-multiplexer 120_1 included in the first-stage gate driving unit according to embodiment of FIG. 1A.

Specifically, the shift register 110_1 includes two sub-circuits 112 and 114, which respectively generate the first control signal SC11 and the second control signal SC12 according to four signals including the start pulse signal STV, a reset signal RES (e.g. the gate signal G5), a forward scanning signal Vfwd and a backward scanning signal Vbwd. Settings of the four signals are determined depending on a forward scan or a backward scan executed by the gate driving circuit 100. For convenient description, FIG. 1B merely illustrates the settings of the four signals for the forward scan, where the forward scanning signal Vfwd is at a high voltage level (e.g. a reference power supply potential), and the backward scanning signal Vbwd is at a low voltage level (e.g. a reference ground potential). As for the backward scan, the forward scanning signal Vfwd is at the low voltage level, and the backward scanning signal Vbwd is at the high voltage level, and the start pulse signal STV and the reset signal RES may be swapped.

The sub-circuit 112 includes transistors T11, T12 and T13. The transistors T11 and 112 are used for determining a voltage level of the first control signal SC11, and the transistor T13 is used for refreshing the first control signal SC11 to stay at a low voltage level (e.g. a voltage level of a low-voltage signal VGL) according to the clock signal CK6. Similarly, the sub-circuit 114 includes transistors 114, T15, 116 and a capacitor C11. The transistors T14 and T15 are used for determining a voltage level of the second control signal SC12, and the transistor T16 is used for refreshing the second control signal SC12 to stay at a high voltage level (e.g. a voltage level of a high-voltage signal VGH) according to the clock signal CK6. Thus, it may be seen that the first control signal SC11 and the second control signal SC12 are generated by the two independent sub-circuits 112 and 114.

In addition, the de-multiplexer 120_1 may be turned on for sequentially receiving clock signals CK1~CK4 and generating the corresponding gate signals G1~G4 sequentially when the first control signal SC11 is at the high voltage level and the second control signal SC12 is at the low voltage level. Besides, the de-multiplexer 120_1 may be turned off when the first control signal SC11 is at the low voltage level and the second control signal SC12 is at the high voltage level. Herein, transistors T17*a*, T18*a*, T19*a* and a capacitor C12 are used for receiving the clock signal CK1 and generating the gate signal G1, transistors T17*b*, T18*b*, T19*b* and a capacitor C13 are used for receiving the clock signal CK2 and generating the gate signal G2, transistors T17*c*, T18*c*, T19*c* and a capacitor C14 are used for receiving the clock signal CK3 and generating the gate signal G3, and transistors T17*d*, T18*d*, T19*d* and a capacitor C15 are used for receiving the clock signal CK4 and generating the gate signal G4.

Figure 1B:
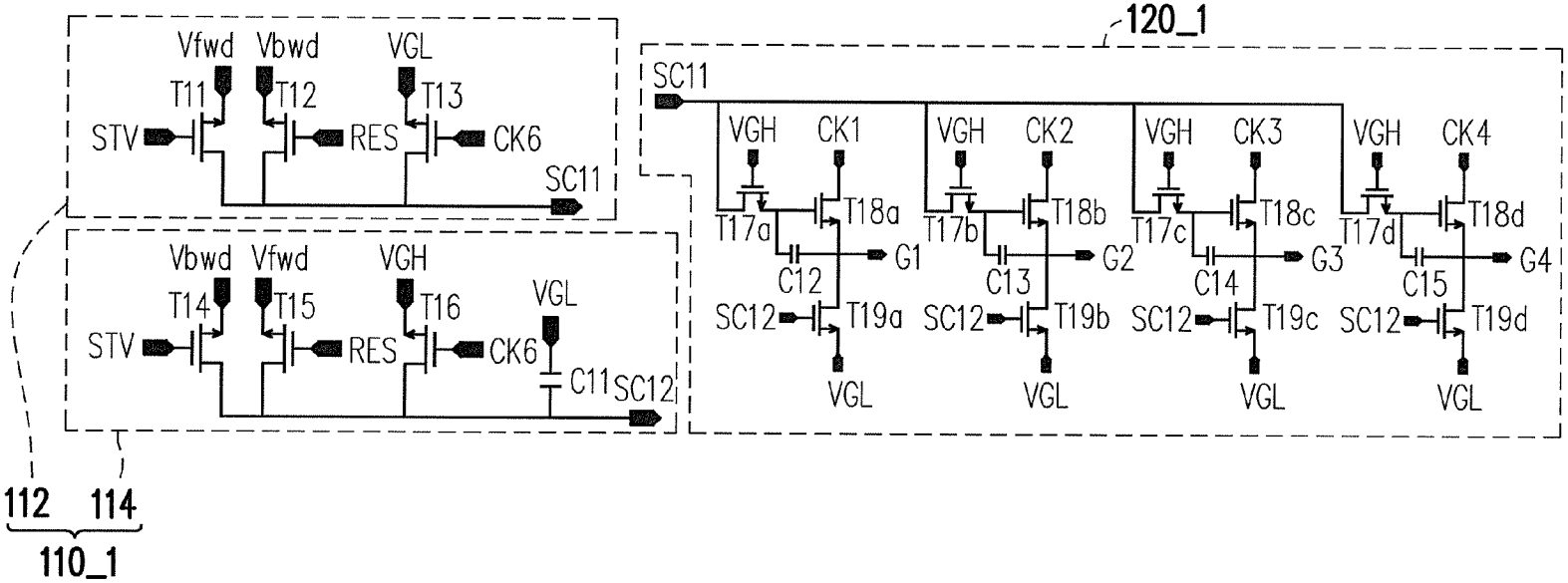
FIG. 1B is a circuit diagram illustrating a shift register and a de-multiplexer included in the first-stage gate driving unit according to embodiment of FIG. 1A.
Figure 1C:
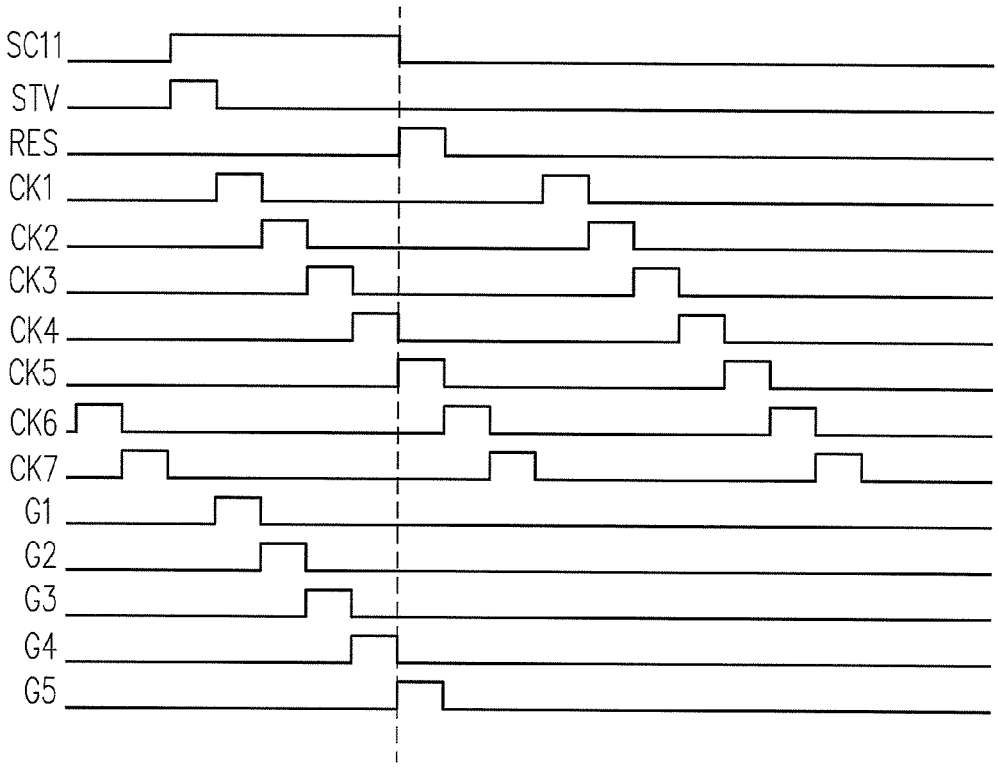
FIG. 1C is a schematic diagram illustrating a start pulse signal, a first control signal, clock signals and gate signals according to embodiments of FIG. 1A and FIG. 1B.

FIG. 1C is a schematic diagram illustrating the start pulse signal STV, the first control signal SC11, clock signals CK1~CK7 and gate signals G1~G5 according to the embodiments of FIG. 1A and FIG. 1B. Herein, it may be seen that enable periods of the clock signals CK1~CK7 are not overlapped.

Referring to FIG. 1A to FIG. 1C, for the forward scan (i.e. the forward scanning signal Vfwd is at the high voltage level, and the backward scanning signal Vbwd is at the low voltage level), the shift register 110_1 receives the start pulse signal STV by the transistor T11 and receives the reset signal RES (e.g. the gate signal G5) by the transistor T12. When the start pulse signal STV is enabled (i.e. at the high voltage level), the sub-circuit 112 generates the first control signal SC11 at the high voltage level, the sub-circuit 114 generates the second control signal SC12 at the low voltage level, and the de-multiplexer 120_1 may be turned on accordingly. The de-multiplexer 120_1 receives clock signals CK1~CK4 sequentially, and generates gate signal G1~G4 sequentially, where the de-multiplexer 120_1 may provide gate signal G4 to the shift register 110_2 as the start pulse signal of the next stage. Then, when the clock signal CK5 is enabled (i.e. at the high voltage signal), the shift register 110_1 disables the first control signal SC11 (at the low voltage level) and enables the second control signal SC12 (at the high voltage level), and the de-multiplexer 120_1 may be turned off accordingly.

From the above, the first control signal SC11 and the second control signal SC12 are independent to each other, and the clock signal CK1~CK7 are also independent (i.e. the enable periods of the clock signals CK1~CK7 are not overlapped). Although signal interferences may be avoided by using the aforementioned independent signals, however, the gate driving circuit 100 with the independent signals may be incapable of pre-charging the gate signals G1~Gm, and therefore may be difficult to provide a driving voltage high enough for driving a display panel with high resolution. Thus, an improving gate driving circuit will be provided in the following embodiments, which may achieve good driving capability by executing the pre-charging operation, so as to be adapted to the display panels with high resolution.

Figure 2:
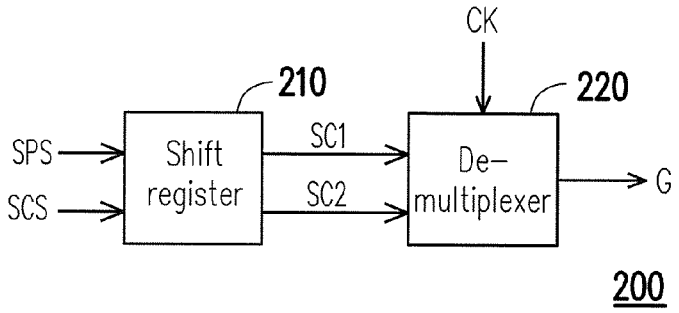
FIG. 2 is a schematic diagram illustrating a gate driving unit according to an embodiment of the invention.

In specific, a gate driving circuit disclosed by the embodiments of the invention includes a plurality of gate driving units sequentially coupled to each other. Referring to FIG. 2, FIG. 2 is a schematic diagram illustrating a gate driving unit according to an embodiment of the invention. A gate driving unit 200 includes a shift register 210 and a de-multiplexer 220, where the functionalities thereof are given as follows.

The shift register 210 receives a start pulse signal SPS, and generates a first control signal SC1 and a second control signal SC2 according to the start pulse signal SPS and a scan controlling signal SCS, wherein when the shift register 210 converts the first control signal SC1 into the second control signal SC2, the shift register 210 pulls down a voltage level of the first control signal SC1 according to the second control signal SC2.

The de-multiplexer 220 is coupled to the shift register 210. The de-multiplexer 220 receives a part of a plurality of clock signals CK for generating a plurality of gate signals G sequentially according to the first control signal SC1, wherein the clock signals CK are enabled sequentially, and enable periods of two sequential clock signals are partially overlapped with each other. In the present embodiment, the clock signals G may have a same enable period, and the overlapped part may be a half of the same enable period.

In the present embodiment, the gate driving unit 200 may provide the second last gate signal of the generated gate signals G to a next-stage gate driving unit as a start pulse signal of the next-stage gate driving unit. When the gate driving unit 200 is the first-stage gate driving unit of the gate driving circuit, the start pulse signal SPS (e.g. the start pulse signal STV illustrated in FIG. 3A) may be determined since each of the gate signals G is provided to the gate driving units in turn.

Based on the aforementioned circuit design, the embodiment may allow the gate signals G to be pre-charged, and therefore the gate signals G with a sufficient high voltage level may be effectively achieved, so as to enhance the driving capability.

Details of the gate driving circuit disclosed by the embodiments of the invention will be described as follows.

Specifically, in the present embodiment, the gate driving circuit may receives k clock signals, and each of the de-multiplexers receives n clock signals in the k clock signals for generating n gate signals sequentially, where k and n are positive integers and k is larger than n.

Figure 3A:
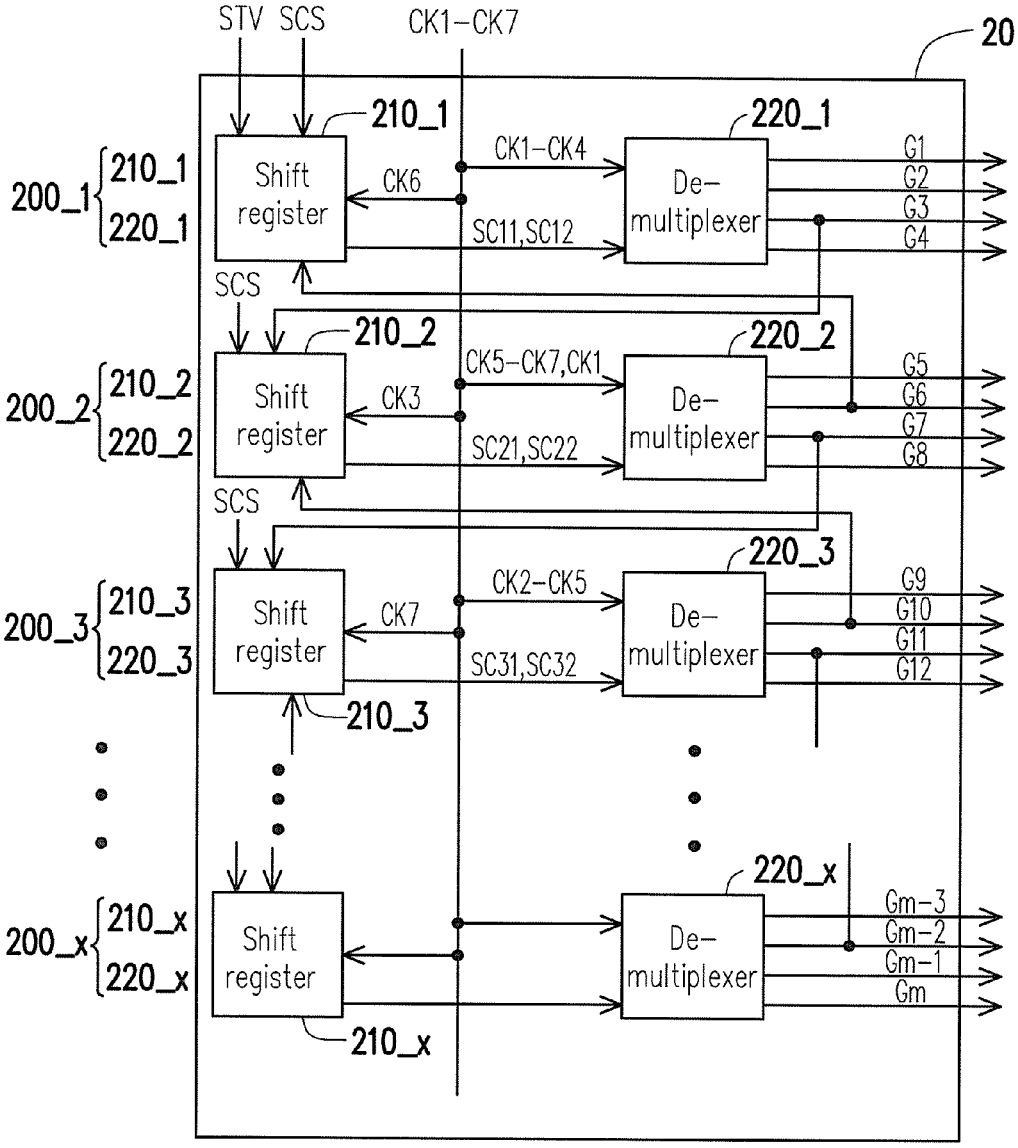
FIG. 3A is a schematic diagram illustrating a gate driving circuit according to an embodiment of the invention.

Here is an exemplary embodiment corresponding to n is 4 and k is 7. Referring to FIG. 3A, FIG. 3A is a schematic diagram illustrating a gate driving circuit according to an embodiment of the invention. A gate driving circuit 20 includes a plurality of gate driving units 200_1~**200_*x* sequentially coupled to each other. Each of the gate driving units 200_1~200_*x* may include a shift register (e.g. 210_1~210_*x*) and a de-multiplexer (e.g. 220_1~220_*x*), and the shift register generates a first control (e.g. SC11~SC31) signal and a second control signal (SC12~SC32) according to a start pulse signal (e.g. a start pulse signal STV for the gate driving unit 200_1, a gate signal G3 for the gate driving unit 200_2, a gate signal G7 for the gate driving unit 200_3**, and so on) and a scan controlling signal SCS.

For instance, the gate driving unit 200_1 includes a shift register 210_1 and a de-multiplexer 2201, and the shift register 210_1 generates the first control signal SC11 and the second control signal SC12 according to the start pulse signal STV and the scan controlling signal SCS.

In the present embodiment, the gate driving circuit 20 may receive 7 clock signals CK1~CK7, and each of the de-multiplexers (e.g. 220$_{_1}$~**220_*x*) may receive 4 clock signals in the 7 clock signals CK1~CK7 sequentially for generating 4 gate signals sequentially. For instance, the de-multiplexer 220_1 sequentially receives the clock signals CK1~CK4 for generating gate signals G1~G4 sequentially, the de-multiplexer 220_2 sequentially receives the clock signals CK5~CK7 and CK1 for generating gate signals G5~G8 sequentially, and the de-multiplexer 220_3 sequentially receives the clock signals CK2~CK5 for generating gate signals G9~G12** sequentially.

It should be noted that, the de-multiplexers (e.g. 220_1~**220_*x*) may sequentially generate n gate signals and provide the (n−1)th gate signal (e.g. the gate signals G3, G7 and G11) in the n gate signals as a start pulse signal of a next-stage gate driving unit. For instance, the de-multiplexer 220_1 generates gate signals G1~G4, and provides the gate signal G3 as a start pulse signal of the gate driving unit 200_2. Hence, the present embodiment may turn on the next-stage gate driving unit earlier than the embodiment of FIG. 1**A, and thus may allow the enable periods of the two sequential clock signals being partially overlapped to each other.

Herein, a circuit configuration of the gate driving unit 200_1 including the shift register 210_1 and the de-multiplexer 220_1 in the embodiment of FIG. 3A will be described in detail, and circuit configurations of other gate driving units in the embodiment of FIG. 3A may be similar.

Figure 3B:
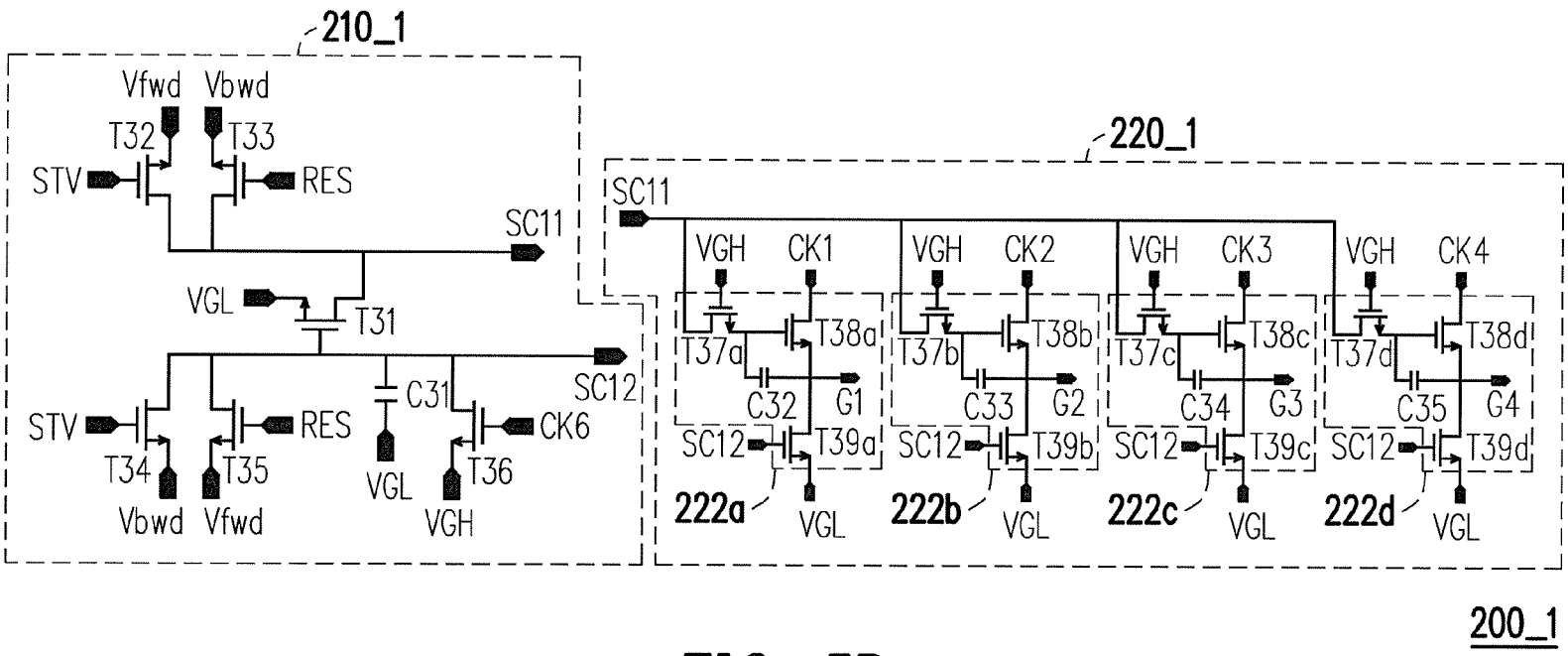
FIG. 3B is a circuit diagram illustrating a gate driving unit according to an embodiment of FIG. 3A.

Referring to FIG. 3B, FIG. 3B is a circuit diagram illustrating a gate driving unit according to an embodiment of FIG. 3A. Similar to the aforementioned embodiment, the present embodiment may be adapted to both of the forward scan and the backward scan, although FIG. 1B merely illustrates the settings of signals for the forward scan for convenient description.

In the present embodiment, the shift register 210_1 may generate the first control signal SC11 and the second control signal SC12 dependently. Particularly, the shift register 210_1 may include a pull-down switch. The pull-down switch may receive the first control signal SC11 and the second control signal SC12, and my be turned on or off according to the second control signal SC12 for pulling down the voltage level of the first control signal SC11 to a low-voltage signal.

The pull-down switch may be a transistor T31. Specifically, the transistor T31 has a first end, a second end and a control end. The first end of the transistor T31 receives the first control signal SC1, the second end of the transistor T31 receives a low-voltage signal VGL (with a low voltage level as mentioned above), and the control end of the transistor T31 receives the second control signal SC2.

In addition, the shift register 210_1 further includes transistors T32~T36 and a capacitor C31. The transistors T32~T33 are used for generating the first control signal SC11, and the transistors T34~T35 are used for generating the second control signal SC12. Besides, the transistor T36 and the capacitor C31 may be used for refreshing the first control signal SC11 and the second control signal SC12.

Each of the transistors T32~T36 has a first end, a second end and a control end. Herein, the first end of the transistor T32 receives the forward scanning signal Vfwd, and the control end of the transistor T32 receives the start pulse signal STV. In addition, the first end of the transistor T33 receives the backward scanning signal Vbwd, the control end of the transistor T33 receives a reset signal RES, and the second end of the transistor T33 and the second end of the transistor T32 are coupled to each other and generate the first control signal SC11. Further, the first end of the transistor T34 receives the backward scanning signal Vbwd, and the control end of the transistor T34 receives the start pulse signal STV. Besides, the first end of the transistor T35 receives the forward scanning signal Vfwd, the control end of the transistor T35 receives the reset signal RES, and the second end of the transistor T35 and the second end of the transistor T34 are coupled to each other and generate the second control signal SC12.

It should be noted that the shift register 210_1 may determine a voltage level of the forward scanning signal Vfwd according to the scan controlling signal SCS, and may determine a voltage level of the backward scanning signal Vbwd according to the scan controlling signal SCS, where the voltage levels of the forward scanning signal Vfwd and the backward scanning signal Vbwd are different.

Besides, the reset signal RES may be determined according to the second gate signal generated by the next-stage gate driving circuit. For the gate driving circuit 200_1, the reset signal RES is gate signal G6, which is the second gate signal generated by the gate driving circuit 200_2.

Hence, for the forward scan, the shift register 210_1 may use the scan controlling signal SCS to control the forward scanning signal Vfwd at the high voltage level while the backward scanning signal Vbwd at the low voltage level. Besides, referring to the settings of the signals, the start pulse signal STV may be provided to the transistors T32 and T34, while the reset signal RES may be provided to the transistors T33 and T35.

On the other hand, for the backward scan, the shift register 210_1 may use the scan controlling signal SCS to control the forward scanning signal Vfwd at the low voltage level while the backward scanning signal Vbwd at the high voltage level. Besides, referring to the settings of the signals, the start pulse signal STV may be provided to the transistors T33 and T35 while the reset signal RES may be provided to the transistors T32 and T34. In other words, with respect to the forward scan, the setting of the start pulse signal STV and the reset signal RES may be swapped.

Moreover, the first end of the transistor T36 receives a high-voltage signal VGH (with a high voltage level as mentioned above), the second end of the transistor T36 is commonly coupled to the second ends of the transistor T35 and the transistor T34, and the control end of the transistor T36 receives a refresh signal, where the refresh signal is one of the k clock signals except from the n clock signals. As for the capacitor C31, one end of the capacitor C31 receives the low-voltage signal VGL, and another end of the capacitor C31 is coupled to the second end of the transistor T36.

Particularly, the refresh signal may be determined according to a second clock signal received by the next-stage gate driving unit. Hence, as illustrated in FIG. 3A and FIG. 3B, the refresh signal received by the gate driving circuit 200_1 is the clock signal CK6, which is the second clock signal received by the gate driving unit 200_2.

On the other hand, the de-multiplexer 220_1 may receive the first control signal SC11 and the second control signal SC12 generated by the shift register 210_1, and may generate the gate signals G1~G4 according to the first control signal SC11, the second control signal SC12, and the clock signals CK1~CK4.

In detail, the de-multiplexer 220_1 includes a plurality of signal transmitting units 222*a*~222*d*, which receives the clock signals CK1~CK4, the first control signal SC11 and the second control signal SC12. The signal transmitting units 222*a*~222*d* may be turned on simultaneously according to the first control signal SC11, and the signal transmitting units 222*a*~222*d* receives the clock signals CK1~CK4 respectively for generating the gate signals G1~G4 respectively. Besides, the signal transmitting units 222*a*~222*d* may be turned off simultaneously according to the second control signal SC12, and therefore no signal may be transmitted through the signal transmitting units 222*a*~222*d*.

For example, the signal transmitting units 222*a*~222*d* may be turned on when the first control signal SC11 is at the high voltage level. At this time, the signal transmitting units 222*a* may receive the clock signal CK1 for generating the gate signal G1, the signal transmitting units 222*b* may receive the clock signal CK2 for generating the gate signal G2, the signal transmitting units 222*c* may receive the clock signal CK3 for generating the gate signal G3, and the signal transmitting units 222*d* may receive the clock signal CK4 for generating the gate signal G4. On the other hand, the signal transmitting units 222*a*~222*d* may be turned off when the second control signal SC12 is at the high voltage level. It may be noted that when the first control signal SC11 is at the high voltage level, the second control signal SC12 may be at the low voltage level, while when the first control signal SC11 is at the low voltage level, the second control signal SC12 may be at the high voltage level. In other words, the second control signal SC12 may be an inverting signal of the first control signal SC11.

More specifically, the signal transmitting unit 222*a* includes transistors T37*a*, T38*a*, T39*a* and a capacitor C32. The signal transmitting unit 222*b* includes transistors T37*b*, T38*b*, T39*b* and a capacitor C33. The signal transmitting unit 222*c* includes transistors T37*c*, T38*c*, T39*c* and a capacitor C34. The signal transmitting unit 222*d* includes transistors T37*d*, T38*d*, T39*d* and a capacitor C35. It should be noted that circuit configurations of the signal transmitting units 222*a*, 222*b*, 222*c* and 222*d* are similar, and therefore merely the signal transmitting units 222*a* will be described hereinafter.

In the signal transmitting units 222*a*, each of the transistors T37*a*, T38*a* and T39*a* has a first end, a second end and a control end. In detail, the first end of the transistor T37*a* receives the first control signal SC11, and the control end of the transistor T37*a* receives the high-voltage signal VGH. Besides, the first end of the transistor T38*a* receives the clock signal CK1 (i.e. one of the clock signals CK1~CK4, which corresponds to the signal transmitting unit 222*a*), the second end of the transistor T38*a* provides the gate signal G1 corresponding to the signal transmitting unit 222*a*, and the control end of the transistor T38*a* is coupled to the second end of the transistor T37*a*. In addition, the capacitor C32 is coupled between the control end of the transistor T38*a* and the second end of the transistor T38*a*. Further, the first end of the transistor T39*a* is coupled to the second end of the transistor T38*a*, the second end of the transistor T39*a* receives the low-voltage signal VGL, and the control end of the transistor T39*a* receives the second control signal SC12.

Figure 4:
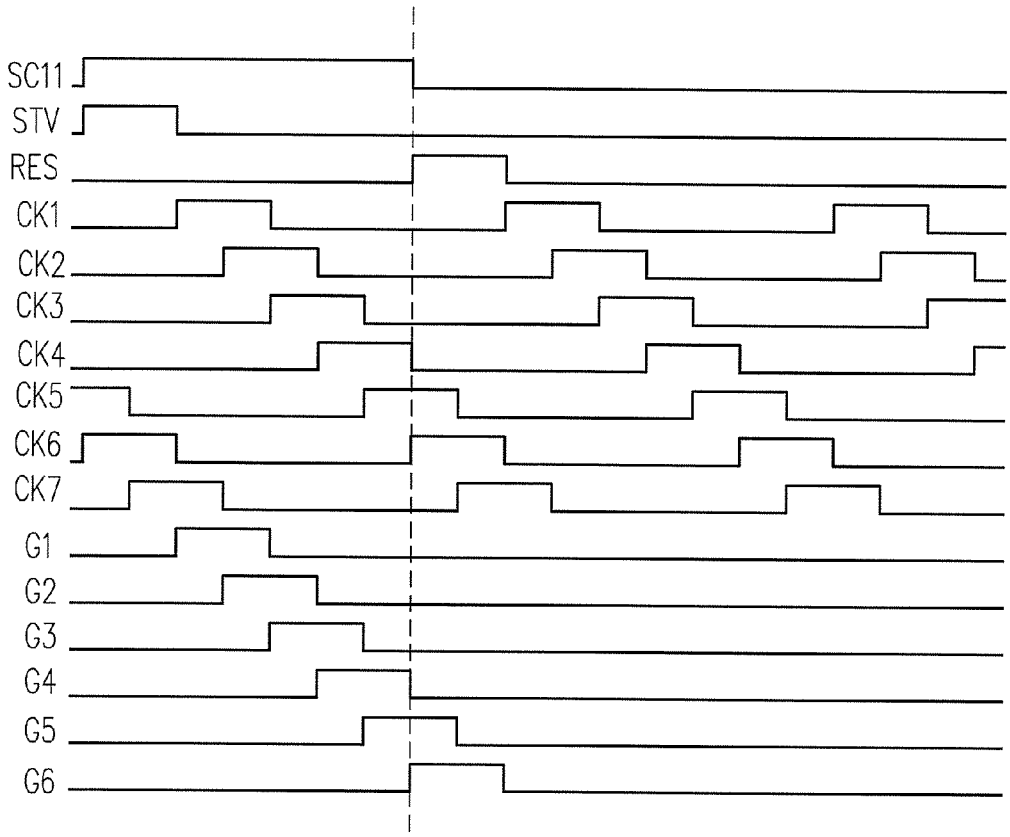
FIG. 4 is a schematic diagram illustrating a first control signal, a start pulse signal, a plurality of clock signals and a plurality of gate signals according to the embodiments of FIG. 3A and FIG. 3B.

Referring to FIG. 3A, FIG. 3B and FIG. 4, FIG. 4 is a schematic diagram illustrating a first control signal, a start pulse signal, a plurality of clock signals and a plurality of gate signals according to the embodiments of FIG. 3A and FIG. 3B. The shift register 210_1 receives the start pulse signal STV and the gate signal G5.

Taking the forward scan as an example for explaining the operation of the gate driving circuit 200_1 in detail. As mentioned above, the shift register 210_1 may use the scan controlling signal SCS to control the forward scanning signal Vfwd at the high voltage level while the backward scanning signal Vbwd at the low voltage level. When the start pulse signal STV is enabled to the high voltage level, the transistor T32 and T34 are turned on, so as to generate the first control signal SC11 with the high voltage level and the second control signal SC12 with the low voltage level. Besides, the signal transmitting units 222*a*~222*d* are turned on simultaneously.

In the present embodiment, the transistors T37*a*~T37*d* may keep being turned on due to the high-voltage signal VGH. In addition, the capacitors C32~C35 may be charged by the first control signal SC11, and the transistors T38*a*~T38*d* may be turned on by the first control signal SC11. The signal transmitting units 222*a*~222*d* receive the clock signals CK1~CK4 respectively through the transistors T38*a*~T38*d*. Since the clock signals CK1~CK4 are enabled sequentially, the signal transmitting units 222*a*~222*d* generate the gate signals G1~G4 sequentially accordingly. In particular, the enable periods of two sequential clock signals are partially overlapped with each other, and hence each of the gate signals G1~G4 may be pre-charged. Herein, the gate driving unit 200_1 may provide the gate signal G3 to the next-stage gate driving unit 200_2 as the start pulse signal of the gate driving unit 200_2.

Then, when the next-stage gate driving unit 200_2 generates the gate signal G6, the gate driving unit 200_1 may receive the gate signal G6 as the reset signal RES, such that the transistors T33 and T35 are turned on. Therefore, the voltage level of the first control signal SC11 may be switched to the low voltage level, the second control signal SC12 may be switched to the high voltage level, and the signal transmitting units 222*a*~222*d* may be turned off simultaneously.

It should be noted that, at this time, the transistor T31 may be turned on since the second control signal SC2 is at the high-voltage level, so as to pull down the voltage of the first control signal SC1 to the low voltage level rapidly. By contrast, as for the voltage level of the second control signal SC2 being the low voltage level, the transistor T31 may be turned off, such that the first control signal SC1 and the second control signal SC2 may be independent.

Besides, the refresh signal (e.g. the clock signal CK6 for the gate driving circuit 200_1) may be used for holding the voltage level of the first control signal SC11 at the low voltage level and the voltage level of the second control signal SC12 at the high voltage level until the start pulse signal STV is enabled.

In the aforementioned embodiments, the transistors T37*a*~T37*d* keep being turned on. In another embodiment, the control end of the transistor T37*a* may receive a turn-on control signal, and the turn-on control signal may be the (n−1)th clock signal received by a previous-stage gate driving unit (the transistors T37*b*~T37*d* are similar, so hereinafter merely the transistor T37*a* is described for convenience). For instance, the transistor T37*a* of the de-multiplexer 220_1 may receive the gate signal G6, the transistor T37*a* of the de-multiplexer 220_2 may receive the gate signal G3, and the transistor T37*a* of the de-multiplexer 220_3 may receive the gate signal G7. Therefore, the transistor T37*a* may be turned on merely during a part of an enable period (i.e. at the high voltage level) of the first control signal SC11, so as to avoid the voltage level of the first control signal SC11 to be affected by the gate signals.

It is worth mentioning that, in the present embodiment, the start pulse signal, the refresh signal and the turn-on control signal corresponding to a same gate driving unit may be a same clock signal of the k clock signals. For example, the start pulse signal STV, the refresh signal and the turn-on control signal corresponding to the gate driving unit 200_1 is the clock signal CK6.

Therefore, since the gate driving circuit disclosed by the embodiments of the invention may allow the enable periods of the clock signals to be overlapped, the generated gate signals may be pre-charged accordingly, such that the driving capability may be enhanced.

Figure 5:
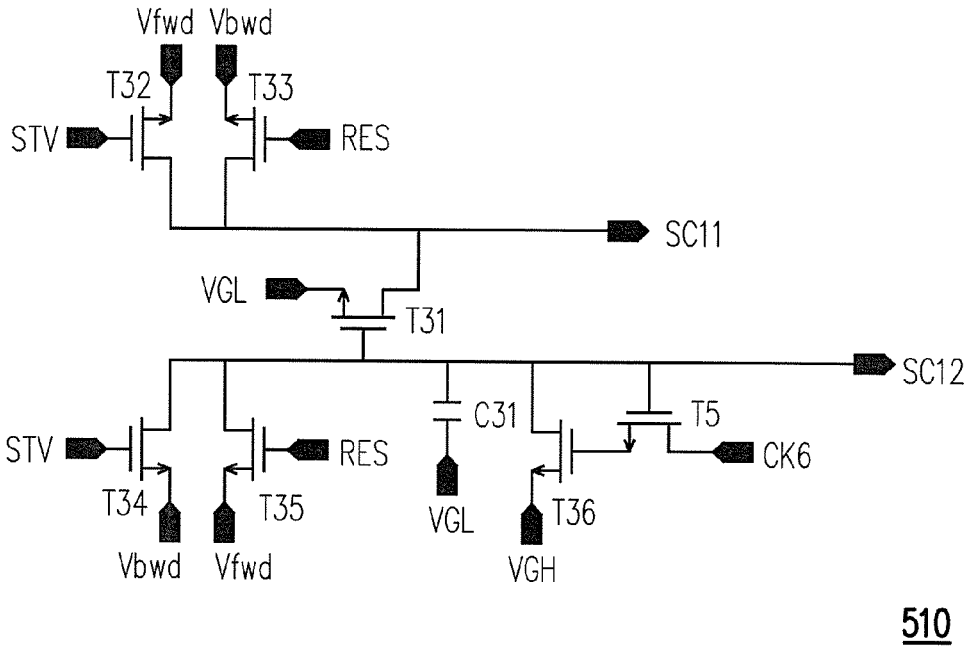
FIG. 5 is a circuit diagram illustrating a gate driving unit according to another embodiment of the invention.

Moreover, another circuit configuration will be provided as follows. Referring to FIG. 5, FIG. 5 is a circuit diagram illustrating a gate driving unit according to another embodiment of the invention. The embodiment of FIG. 5 is similar to the embodiment of FIG. 3B, and similarities are not mentioned here. Herein, the shift register 510 in the embodiment disclosed by FIG. 5 further includes an isolated switch (e.g. a transistor T5) coupled to the control end of the transistor T36. The isolated transistor may receive the second control signal SC12, and may turns on or off according to the second control signal SC12, where the transistor T36 receives the refresh signal (e.g. the clock signal CK6) through the isolated switch. Hence, the present embodiment may avoid the refresh signal to affect the voltage level of the first control signal SC11, particularly when the first control signal SC11 and the second control signal SC12 are switched to each other.

From the above, it is worth mentioning that a number of the clock signals used by the gate driving circuit and a number of the clock signals received by each of the de-multiplexers are mutually prime, such that each of the clock signals may be provided to the shift registers in turn to balance the electricity load of the clock signals. For instance, in another embodiment, the number of the clock signals used by the gate driving circuit may be 8, and the number of the clock signals received by each of the de-multiplexers may be 5, which may be adaptively adjusted based on design requirements, and the invention is not intended t limit thereto.

It should be also noted that the embodiments of the invention may also be applied for bi-directional driving architecture. In this case, the gate driving units may be divided into two groups to drive the display panel respectively from two sides of the display panel. In addition, there may be a phase difference of 1/14 between signals used by two gate driving units arranged at the corresponding positions at both sides of the display panel. In other words, when the timing diagram illustrated in FIG. 4 is applied for a gate driving unit at one side of the display panel, a timing diagram applied for a gate driving unit at the other side of the display panel may be obtained by shifting the phase difference of 1/14 to the timing diagram illustrated in FIG. 4.

Besides, although the aforementioned embodiments are implemented by using N-type transistors, P-type transistors may also be adapted, which depends on design requirements.

To conclude the above, the gate driving circuit according to the embodiments of the invention may allow enable periods of two sequential clock signals to be overlapped with each other, so as to pre-charge gate signals effectively. Particularly, through adequate design, a same clock signal may be used for the start pulse signal, the refresh signal and the turn-on control signal corresponding to a same gate driving unit, which may simplify overall configuration of the gate driving circuit. Thereby, the driving capability may be enhanced, and the design requirements of high resolution and narrow border may be achieved.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A gate driving circuit comprising:

a plurality of gate driving units, sequentially coupled to each other, wherein each of the gate driving units comprises:

a shift register, receiving a start pulse signal, and generating a first control signal and a second control signal according to the start pulse signal and a scan controlling signal, wherein when the shift register converts the first control signal into the second control signal, the shift register pulls down a voltage level of the first control signal according to the second control signal; and a de-multiplexer, coupled to the shift register, receiving a part of a plurality of clock signals for generating a plurality of gate signals sequentially according to the first control signal, wherein the clock signals are enabled sequentially, and enable periods of two sequential clock signals are partially overlapped with each other, wherein the gate driving circuit receives k clock signals, and each of the de-multiplexers receives n clock signals in the k clock signals sequentially for generating n gate signals sequentially, wherein k, n are positive integers and k is larger than n, and the de-multiplexer provides the (n−1)th gate signal in the n gate signals as a start pulse signal of a next-stage gate driving unit, wherein the shift register comprises:

a pull-down switch, comprising a first transistor, receiving the first control signal and the second control signal, and turned on or off according to the second control signal for pulling down the voltage level of the first control signal to a low-voltage signal;

a second transistor, having a first end, a second end and a control end, wherein the first end of the second transistor receives a forward scanning signal, and the control end of the second transistor receives the start pulse signal;

a third transistor, having a first end, a second end and a control end, wherein the first end of the third transistor receives a backward scanning signal, the control end of the third transistor receives a reset signal, and the second end of the third transistor and the second end of the second transistor are coupled to each other and generate the first control signal;

a fourth transistor, having a first end, a second end and a control end, wherein the first end of the fourth transistor receives the backward scanning signal, and the control end of the fourth transistor receives the start pulse signal; and a fifth transistor, having a first end, a second end and a control end, wherein the first end of the fifth transistor receives the forward scanning signal, the control end of the fifth transistor receives the reset signal, and the second end of the fifth transistor and the second end of the fourth transistor are coupled to each other and generate the second control signal, wherein the shift register determines a voltage level of the forward scanning signal according to the scan controlling signal, and determines a voltage level of the backward scanning signal according to the scan controlling signal, wherein the voltage levels of the forward scanning signal and the backward scanning signal are different.

2. The gate driving circuit according to claim 1, wherein:

the first transistor has a first end, a second end and a control end, the first end of the first transistor receives the first control signal, the second end of the first transistor receives the low-voltage signal, and the control end of the first transistor receives the second control signal.

3. The gate driving circuit according to claim 1, wherein the reset signal is determined according to the second gate signal generated by the next-stage gate driving circuit.

4. The gate driving circuit according to claim 1, wherein the shift register further comprises:

a sixth transistor, having a first end, a second end and a control end, wherein the first end of the sixth transistor receives a high-voltage signal, the second end of the sixth transistor is commonly coupled to the second ends of the fifth transistor and the fourth transistor, and the control end of the sixth transistor receives a refresh signal, wherein the refresh signal is one of the k clock signals except from the n clock signals; and a first capacitor, wherein one end of the first capacitor receives the low-voltage signal, and another end of the first capacitor is coupled to the second end of the sixth transistor.

5. The gate driving circuit according to claim 4, wherein the refresh signal is determined according to a second clock signal received by the next-stage gate driving unit.

6. The gate driving circuit according to claim 4, wherein the shift register further comprises:

an isolated switch, coupled to the control end of the sixth transistor, wherein the isolated transistor receives the second control signal, and turns on or off according to the second control signal, wherein the sixth transistor receives the refresh signal through the isolated switch.

7. The gate driving circuit according to claim 1, wherein the de-multiplexer comprises:

a plurality of signal transmitting units, receiving the n clock signals, the first control signal and the second control signal, wherein the signal transmitting units are turned on simultaneously according to the first control signal, and the signal transmitting units receives the n clock signals respectively for generating the n gate signals respectively, wherein the signal transmitting units are turned off simultaneously according to the second control signal.

8. The gate driving circuit according to claim 7, wherein the signal transmitting units are turned on or off according to a turn-on control signal, where the turn-on control signal is the (n−1)th clock signal received by a previous-stage gate driving circuit.

9. The gate driving circuit according to claim 7, wherein each of the signal transmitting units comprises:

a seventh transistor, having a first end, a second end and a control end, wherein the first end of the seventh transistor receives the first control signal, and the control end of the seventh transistor receives a high-voltage signal;

an eighth transistor, having a first end, a second end and a control end, wherein the first end of the eighth transistor receives one of the n clock signals, the second end of the eighth transistor provides a gate signal corresponding to each of the signal transmitting units, and the control end of the eighth transistor is coupled to the second end of the seventh transistor;

a second capacitor, coupled between the control end of the eighth transistor and the second end of the eighth transistor; and a ninth transistor, having a first end, a second end and a control end, the first end of the ninth transistor is coupled to the second end of the eighth transistor, the second end of the ninth transistor receives a low-voltage signal, and the control end of the ninth transistor receives the second control signal.

10. The gate driving circuit according to claim 9, wherein the control end of the seventh transistor further comprises receiving a turn-on control signal, where the turn-on control signal is the (n−1)th clock signal received by a previous-stage gate driving circuit.

11. The gate driving circuit according to claim 10, wherein the start pulse signal, a refresh signal and the turn-on control signal corresponding to a same gate driving unit are a same clock signal of the k clock signals.

12. The gate driving circuit according to claim 1, wherein the second control signal is an inverting signal of the first control signal.

13. The gate driving circuit according to claim 1, wherein a number of the clock signals used by the gate driving circuit and a number of the clock signals received by each of the de-multiplexers are mutually prime.

* * * * *